United States Patent [19]

Mealing et al.

[11] 4,356,589

[45] Nov. 2, 1982

[54] REFUSE COLLECTING APPARATUS

[75] Inventors: Barrie E. Mealing; Raymond H. Payne, both of Warwick, England

[73] Assignee: Hestair Eagle Limited, Warwick, England

[21] Appl. No.: 206,203

[22] Filed: Nov. 12, 1980

[30] Foreign Application Priority Data

Nov. 17, 1979 [GB] United Kingdom ..... 7939865
Mar. 28, 1980 [GB] United Kingdom ..... 8010458

[51] Int. Cl.[3] ..... E01H 1/08

[52] U.S. Cl. ..... 15/320; 15/340; 15/412

[58] Field of Search ..... 15/340, 320, 412; 180/54

[56] References Cited

U.S. PATENT DOCUMENTS

| | | | |
|---|---|---|---|
| 2,458,258 | 1/1949 | Furr | 15/340 |
| 2,951,632 | 9/1960 | Hanson | 15/340 X |
| 3,011,206 | 12/1961 | Breither | 15/340 X |
| 3,447,188 | 6/1969 | Maasberg | 15/340 X |
| 3,886,623 | 6/1975 | Landesman et al. | 15/340 X |

*Primary Examiner*—Chris K. Moore
*Attorney, Agent, or Firm*—Pollock, Vande Sande and Priddy

[57] ABSTRACT

Refuse collecting apparatus for a road sweeper, gully emptier or the like comprises an internal combustion engine driving a fan which is connected to a refuse tank. A refuse collecting nozzle is connected to the tank by a duct whereby suction generated by the fan draws refuse into the tank. The fan is bolted to a flywheel at one end of the crankshaft of the engine whereby the fan is supported for rotation on the bearings of the crankshaft. Thrust means is provided to offset the axial thrust exerted on the crank shaft by fan, the thrust means comprising drillings in a plate of the fan whereby pressure is reduced in a chamber on the non-suction side of the fan. The engine is mounted directly above a water tank in an engine compartment and is cooled by means of a radiator. Air is drawn by another fan into the engine compartment through a radiator from a control compartment in which is located the control equipment for the refuse collecting apparatus.

10 Claims, 7 Drawing Figures

REFUSE COLLECTING APPARATUS

This invention relates to refuse collecting apparatus and more particularly, but not exclusively, to suction operated refuse collecting apparatus in such forms as road sweeping apparatus, and apparatus for collecting refuse from bins, gullies and elsewhere through a positionable nozzle.

In this specification and in the claims, the expressions "road sweeping apparatus" and "road sweeper" are to be interpreted as covering also apparatus similar to road sweeping apparatus but which is intended for sweeping other large surfaces such as pavements or sidewalks, airport runways, and the like. Moreover, except where explicitly stated, the invention is not limited to the use of brushes in such sweeping apparatus since for certain applications brushes are not required, it being sufficient to apply suction through a suitable nozzle to the surface from which refuse is to be removed.

The present invention relates generally to aspects of the provision of an internal combustion engine as a power source for refuse collecting apparatus. A specific example of a machine to which the invention is applicable is a self propelled road sweeper having a primary engine for traction purposes and a secondary or auxiliary engine to operate the road sweeping apparatus. The auxiliary engine is usually mounted in an engine compartment forming part of the road sweeping apparatus, and problems which have arisen in relation to such an engine are the complexity and inherent cost (as original equipment) and the considerable space requirements of the engine and fan assembly used for generating the suction required in such apparatus.

The auxiliary engine and fan assembly is usually mounted in front of the refuse tank of road sweepers and therefore by virtue of the space it takes up it necessarily shortens and lowers the capacity of the refuse tank.

This space requirement and its consequences in relation to the refuse capacity are aggravated by the requirement for a transmission between the auxiliary engine and the fan, and in the case of one well known product this transmission takes the drive from one end of the transversely-mounted engine through two right angle changes of direction to the fan which is mounted on the center line of the vehicle for rotation about a horizontal fore-aft axis behind the engine. Other proposals use less complex drives to the fan but in all cases shafts, bearings and associated transmission components are involved which necessarily introduce cost and space and payload and servicing penalties.

Related problems arise in relation to the general design of the engine compartment for the auxiliary engine. The engine is provided with a heat exchanger such as a liquid to air heat exchanger in the form of a conventional radiator to maintain the correct engine operating temperature. The heat exchanger requires a fan to pass air over its heat exchange surfaces, and problems have arisen in known refuse collecting apparatus in consequence of the interaction of the air flows produced by the primary fan (which generates the necessary suction to operate the road sweeping apparatus) and the secondary fan which passes air over the heat exchanger. Such interaction can occur both inside and outside the engine compartment and can result in insufficient air flow over the heat exchanger for adequate cooling. Also, the heat exchanger and/or the engine compartment can become contaminated by air containing materials from the swept surface.

There is also the problem of the relatively high temperatures generated in the engine compartment of known refuse collecting apparatus. The internal combustion engine is operated at a high level of power output and large quantities of heat have to be dissipated from it. The closed engine compartment necessitated by noise considerations inhibits the dissipation of heat and is unfavourable to the proper operation and service life characteristics of electrical, hydraulic and pneumatic control systems associated with the engine.

A further related problem is that of noise. Legislation limits the amount of noise which may be generated by refuse collecting apparatus, and the auxiliary engine in the engine compartment is a major source of noise. It is therefore desirable to minimize the emission of noise, especially in a lateral direction, from the compartment.

An object of the invention is to provide refuse collecting apparatus offering improvements in respect of one or more of the problems identified above.

According to the invention there is provided suction operated refuse collecting apparatus comprising:

an internal combustion engine;

a fan mounted for rotation by the engine;

a fan housing enclosing the fan and defining an air inlet and an air outlet;

a refuse tank;

a first air duct and a second air duct opening into the refuse tank, the first air duct being connectible to the air inlet of the fan housing; and a refuse collecting nozzle connected to said second air duct whereby refuse can be drawn into the refuse tank through the refuse collecting nozzle by suction generated by the fan;

characterized in that said internal combustion engine comprises a crankshaft and crankshaft bearings supporting the crankshaft and said crankshaft bearings and no other bearings serve to support for rotation both the crankshaft and the fan.

Preferably a flywheel is mounted at one end of said crankshaft and the fan is rigidly secured by fasteners to the flywheel. The fan housing is rigidly secured by fasteners to a cylinder block and crankcase in which the crankshaft is mounted for rotation.

The refuse collecting apparatus may be in the form of self-propelled road sweeping apparatus comprising a self propelled chassis having a primary internal combustion engine arranged to drive road wheels, the other internal combustion engine thus being an auxiliary engine, a driver's cab at the front end of the chassis with respect to the direction of operative forward motion of the road sweeping apparatus, and a refuse tank or hopper at the rear end of the chassis, said auxiliary engine being mounted between the driver's cab and the refuse tank. A compartment for the auxiliary engine is preferably provided at the forward end of the refuse tank. The auxiliary engine may be mounted so that its crankshaft extends transverse to the direction of operative forward motion of the road sweeping apparatus. The auxiliary engine is preferably mounted on top of a water tank to contain water to be used during sweeping operations.

Further features of the invention relate to an arrangement employed to apply compensating axial thrust to the crankshaft, and a novel mounting plate arrangement on one side of which the fan blades are mounted. Said mounting plate preferably has secured thereto at the other side thereof an annular axially-extending mounting collar serving to support the fan on the crankshaft, the collar extending into a non-rotatable housing and cooperating therewith to define a chamber. An annular sealing member may be mounted on an inside surface of said non-rotatable housing so as to cooperate with the mounting collar to restrict the rate of entry of air to said chamber. Alternatively, a pair of annular seal members may be provided, one rotatable with the fan and the other mounted so as to be non-rotatable, the seal members co-operating with each other to form a labyrinth type seal to restrict the rate of entry of air to said chamber.

Further features of the invention relate to means which are employed to reduce the air pressure in the aforementioned chamber, including a conduit extending from the chamber to a region of low air pressure generated by the fan. Preferably means is provided to control the rate of air flow through the said conduit.

According to another aspect of the invention there is provided suction operated refuse collecting apparatus which includes hydraulic and/or electrical and/or pneumatic controls that are preferably located in a control compartment adjacent the engine compartment and having its own air inlet to admit a stream of air for passage through a secondary air inlet. The engine compartment is preferably sealed so that in use a secondary air outlet is the only outlet from the engine compartment for said stream of air. The refuse tank preferably can be tipped to empty the tank, and an upper portion of said engine compartment is mounted with said refuse tank so as to be tippable therewith, a lower portion of the engine compartment being non-tippable and cooperating with the tippable portion in the closed position of the latter to define the engine compartment, resilient sealing material being provided at the cooperating-edges of said compartment portions. The primary and secondary air outlets are preferably formed in a top wall of the engine compartment, and the inlet to the control compartment is formed in a front wall of the control compartment having regard to the direction of operative forward motion of the apparatus. Said hydraulic and/or electrical and/or pneumatic controls may include a hydraulic pump to be driven directly from the crankshaft of the internal combustion engine, the pump being positioned in axial alignment with the crankshaft, and a drive shaft for the pump extending through a central opening in the heat exchanger.

An embodiment of the invention will now be described by wauy of example with reference to the accompanying drawings in which.

Figure 1:
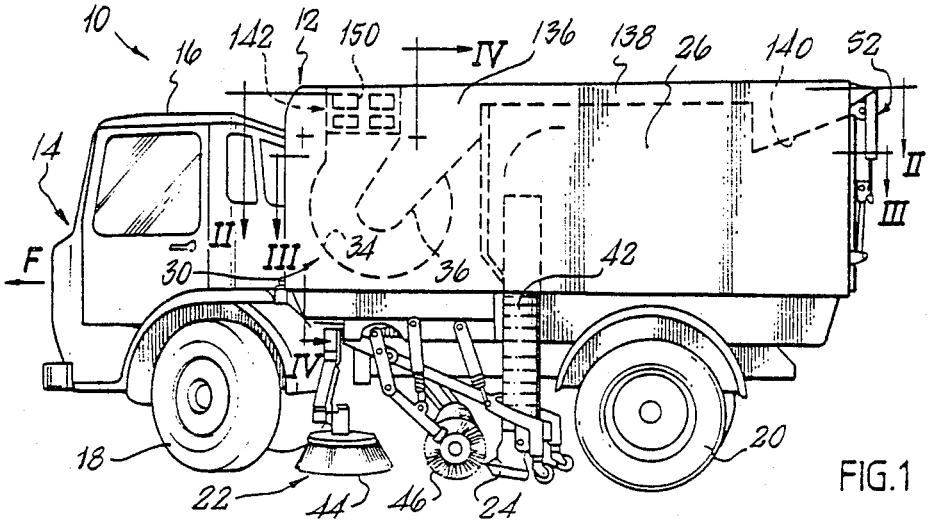
FIG. 1 shows a side elevation view of a road sweeper.
Figure 2:
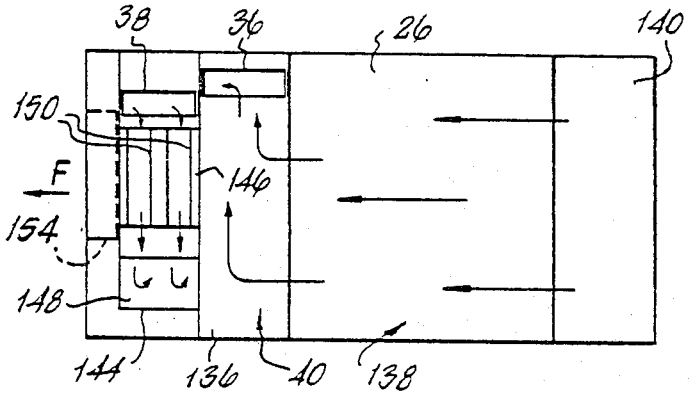
FIGS. 2, 3 and 4 show sections through the refuse tank of the road sweeper of FIG. 1 on the lines II—II, III—III and IV—IV respectively in FIG. 1.

As shown in FIG. 1, a self-propelled road sweeper 10 comprises suction-operated refuse collecting apparatus 12 mounted on a self propelled chassis 14 having a driver's cab 16 and ground wheels 18, 20. Cab 16 encloses a primary diesel engine (not shown), which supplies power for driving rear wheels 20 and a pneumatic compressor (not shown) to operate the vehicle's brakes and a penumatic control system employed in apparatus 12-as described below.

Refuse collecting apparatus 12 comprises brush gear 22 and associated mounting and drive means therefor, a refuse collecting nozzle 24 and a refuse tank 26.

Figure 3:
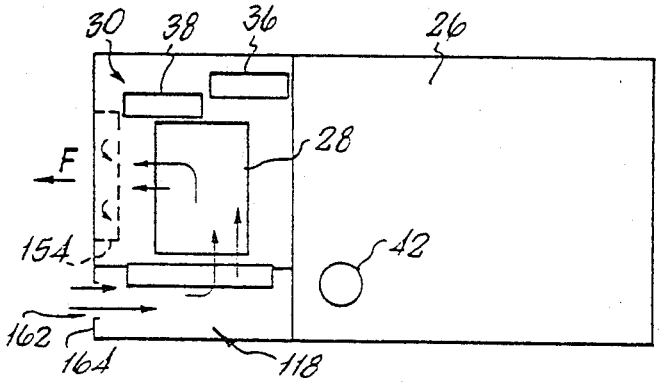

An internal combustion engine 28 (see FIG. 3) is mounted in an engine compartment 30 at the front end of refuse tank 26, having regard to direction F of operative forward motion of the road sweeper. A fan 32 (see FIG. 4) is mounted for rotation by engine 28 and is enclosed by a fan housing 34 which defines an air inlet 36 and an air outlet 38. A first air duct 40 connects air inlet 36 to refuse tank 26, and a second air duct 42 connects the tank to nozzle 24 whereby refuse can be drawn into the refuse tank through the nozzle by suction generated by fan 32.

Brush gear 22 comprises a narrow sweep brush 44 rotatable about an upwardly extending axis, and a cylindrical wide sweep brush 46 rotatable about a generally horizontally extending axis. Brush 44 may be employed without brush 46.

Figure 6:
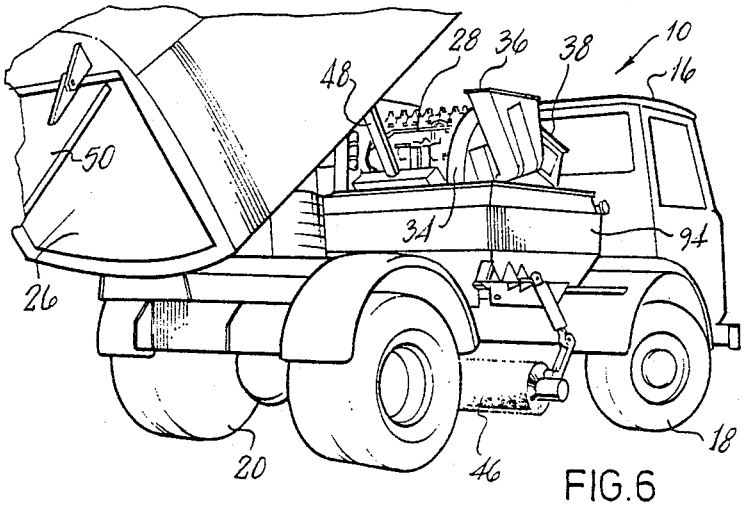
FIGS. 5 and 6 show perspective views from the rear of the road sweeper of FIG. 1, the views being taken from opposite sides of the sweeper and the refuse tank being shown in its tipped condition.
Figure 5:
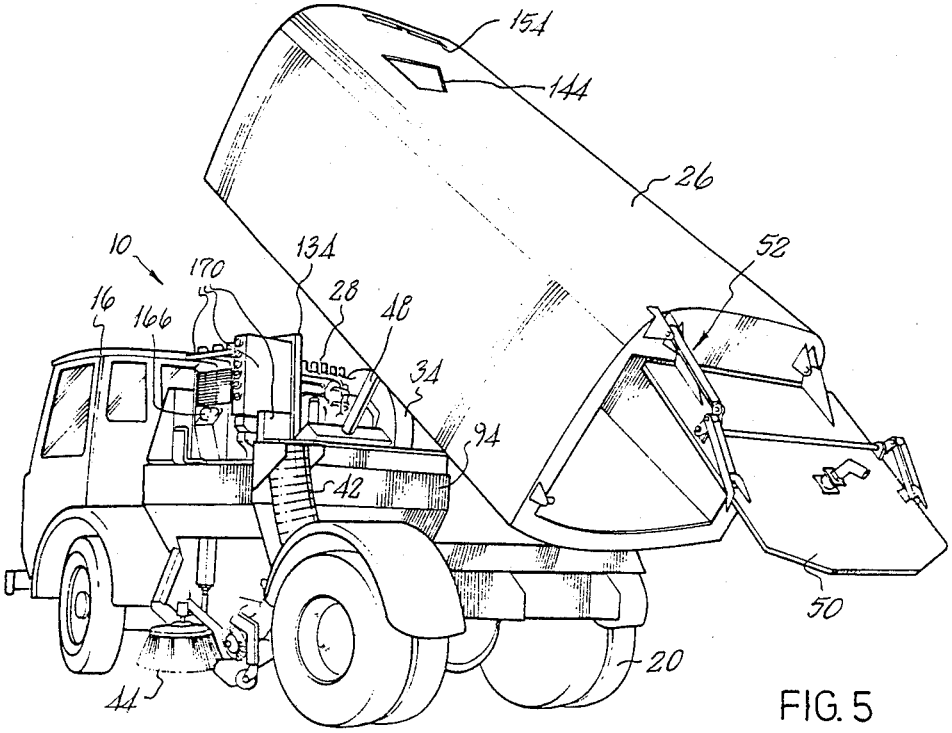

Refuse tank 26 is formed integrally with engine compartment 30 and is mounted on chassis 14 so as to be pivotable relative thereto by means of hydraulic tipping gear 48 (see FIGS. 5 and 6) to a tipped discharge position shown in FIGS. 5 and 6. A rear door 50 is pivotally mounted at the open rear end of the tank for operation by a hydraulic door operating mechanism 52 during tank emptying operations.

Auxiliary engine 28 is a six cylinder in-line turbocharged diesel engine having a crankshaft 54 extending transverse to direction F, and crankshaft bearings 56 supporting the crankshaft for rotation about an axis 58 within the engine block/crank case assembly 60. Engine 28 is mounted within compartment 30 on rubber vibration dampers (not shown).

Fan 32 is a centrifugal or tangential flow fan comprising inner and outer mounting plates 62 and 64 having secured between them a series of curved fan blades 66 located at regular intervals around the periphery of the mounting plates whereby on rotation of the fan about axis 58 air is pumped outwards by the fan blades. Outer mounting plate 64 is formed with a central opening in which is secured an annular inlet duct 68 for rotation with the fan whereby during use, rotation of the fan about axis 58 causes air to be drawn in through duct 68 and discharged outwardly of the fan 32.

Crankshaft 54 has rigidly secured thereto a flywheel 70 which rotates with the crankshaft within a bell housing 72.

Fan 32 is secured to flywheel 70 so as to be coaxial with the crankshaft, by means of an annular axially-extending mounting collar 74 which serves to support the fan on the crankshaft at one end of the crankshaft so that the crankshaft bearings 56, and no other bearings, serve to support for rotation about axis 58 both the crankshaft 54 and the fan 32. A series of fasteners in the form of bolts 76 extending through mounting collar 74 and mounting plate 62 and flywheel 70 secure the fan to the flywheel. Fan housing 34 is rigidly secured by fastening bolts 78 to bell housing 72 which is integral with engine block assembly 60. The fan housing has an inlet opening in which inlet duct 68 is received, an annular sealing member 80 serving to minimize the escape of air outwards therebetween.

In use, fan 32 rotates about axis 58 to draw air into housing 34 through inlet duct 68 and the air is discharged outwardly of the fan causing a reduction of air pressure in the region of axis 58. This reduction of air pressure causes a force acting in the axial direction A to be applied to mounting plate 62 of the fan, and hence a corresponding force is applied to crankshaft 54. In other words, the suction produced by the fan pulls the crankshaft towards the fan.

At the comparatively high rate of rotation of three thousand revolutions per minute at which crankshaft 54 rotates during use, and the high rate of air flow produced, the axial force generated on the crankshaft is comparatively large as compared with the axial loads on the crankshaft in conventional usage of diesel or other internal combustion engines.

The crankshaft bearings in a diesel engine are not designed to stand a large axial load. They are designed to stand a large radial load, and in a typical engine the maximum loading is one hundred tons for radial loads and 0.1 tons for axial loads. Typically only one of the crankshaft bearings is constructed to resist axial loads and therefore the axial loading produced by the suction of the fan 32 may be sufficient to cause undue stress on the engine bearings. Accordingly, thrust means is provided to apply to crankshaft 54 a compensating axial thrust to offset the axial thrust applied thereto by fan 32.

The thrust means comprises a plate (constituted in this embodiment by fan mounting plate 62) forming one end wall of a chamber 82. The other end wall of chamber 82 is formed by parts (not shown) of engine block and crank case assembly 60 which are not supported on crankshaft bearings 56. The side walls of chamber 82 are provided partly by mounting collar 74 and partly by bell housing 72. An annular sealing member 84 is mounted on an inside surface of bell housing 72 and cooperates with mounting collar 74 to restrict the rate of entry of air from the high pressure portion of fan housing 34 into chamber 82 through the annular gap 86 between the rotating and non-rotating parts of the side walls of chamber 82. Sealing member 84 has a groove formed at its inner surface to improve its sealing characteristics.

Figure 7:
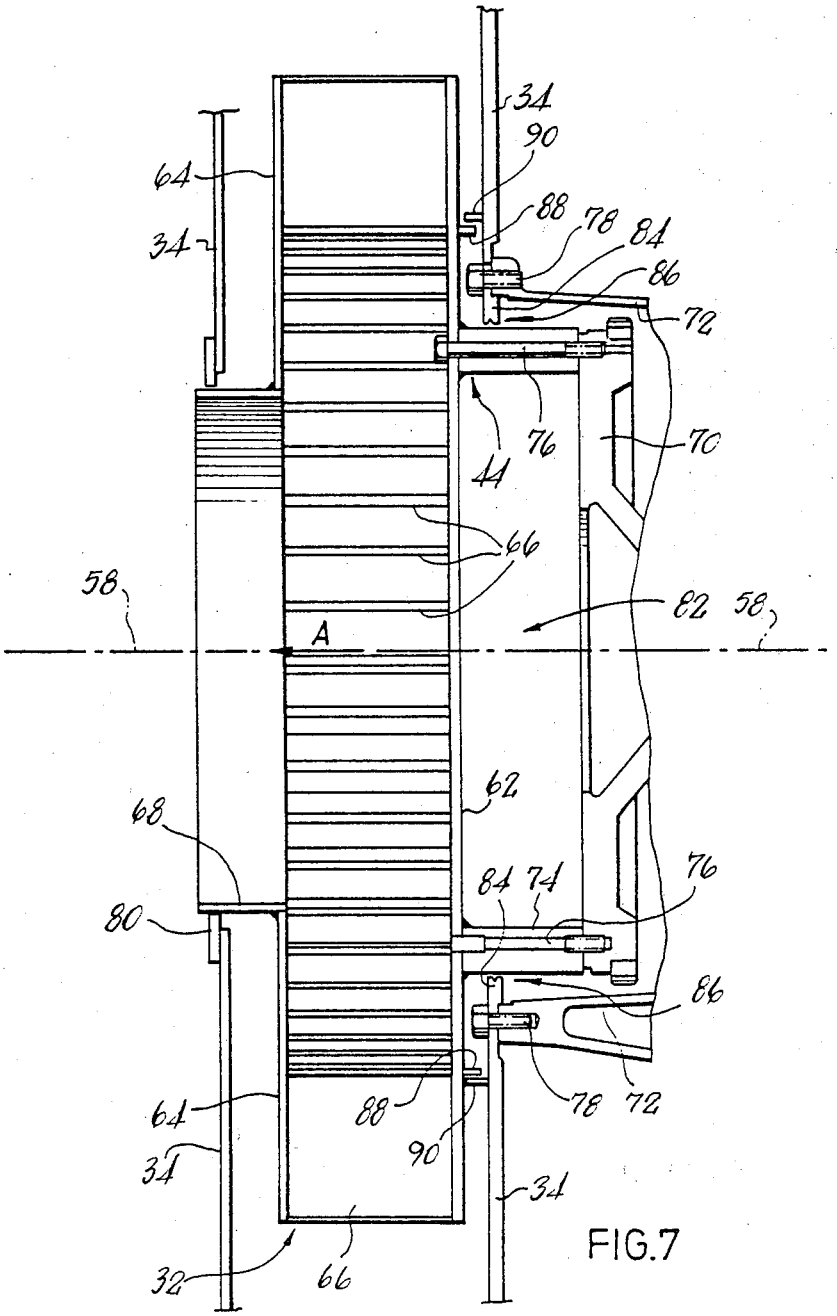
FIG. 7 shows, on a larger scale, a section through a fan assembly also seen (in diagrammatic form) in FIG. 4.

FIG. 7 also shows an alternative sealing arrangement which maybe employed in place of the annular sealing member 84. This alternative comprises a pair of annular axially extending sealing members 88 and 90 secured, one to fan mounting plate 62 so as to be rotatable with the fan and the other secured to fan housing 34 so as to be non-rotatable. The sealing members cooperate with each other to form a labyrinth type seal to restrict the rate of entry of air into chamber 82. It will be understood that with this alternative arrangement the chamber has a larger end wall surface at the fan end of the chamber.

In order to produce an axially-directed thrust on crankshaft 54 in the opposite direction to direction A, means is provided to reduce the air pressure in chamber 82. This means preferably comprises one or more openings or orifices (not seen in FIG. 7) formed (for example by drilling) in fan mounting plate 62 so as to provide an air flow path between chamber 82 and the low pressure region of fan 32 in the region of axis 58. Alternatively, a conduit (not shown) may be provided extending around fan 32 from chamber 82 to the low air pressure region of the fan adjacent axis 58. The conduit may be provided with means such as a valve to control the rate of air flow through the conduit whereby the pressure in chamber 82 (and therefore the compensating thrust) can be controlled. Drillings (not shown) are provided in the inner portion of mounting collar 74 or in flywheel 70 to provide communication between the part of chamber 82 inside collar 74 and the remainder thereof.

In use, the partial evacuation of chamber 82 causes a counter thrust to be applied to mounting plate 62 and hence to crankshaft 54 to partially offset the axial thrust otherwise produced by fan 32. This brings the axial load on the engine crankshaft to within acceptable limits. The counterthrust is automatically related in magnitude to the axial thrust generated by the fan.

It will be understood that there is no need to fully offset the axial load exerted on the crankshaft by the fan. It is merely sufficient to ensure that at all times (even if the air inlet to the fan is blocked) the axial load on the engine crankshaft is within acceptable limits.

Figure 4:
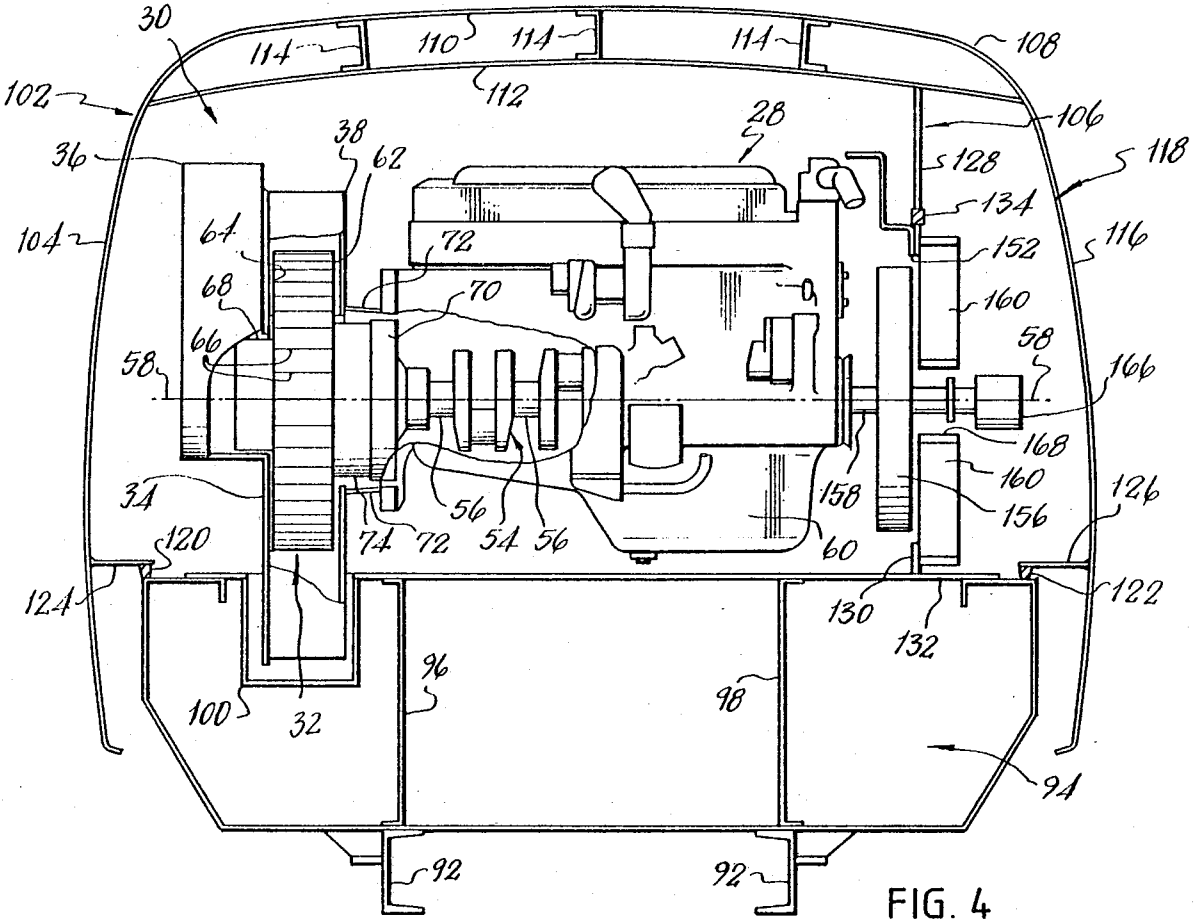

Turning now to the general features of engine compartment 30 as shown in FIG. 4, refuse collecting apparatus 12 is mounted on its own support frame comprising beams 92 extending in direction F. Mounted directly on beams 92 is a water tank 94 from which water is supplied by an electric pump and associated solenoid valves (not shown) to spray gear associated with the brush gear 22 and nozzle 24 to spray water during sweeping operations. Engine 28 is mounted on top of water tank 94 through resilient mountings (not shown) and bearers 96, 98 within the water tank. A concave well or channel 100 is provided in water tank 94 to accommodate fan housing 34.

Engine compartment 30 encloses engine 28 and fan housing 34 and comprises a tippable upper portion 102 and a non-tippable lower portion provided by water tank 94. Upper portion 102 comprises side walls 104 and 106 and a roof 108, all integral with refuse tank 26. Roof 108 comprises upper and lower skins 110 and 112 spaced and stiffened by three longitudinal channel sections 114 to form a four compartment air duct extending lengthwise of the road sweeper. It is to be noted that side wall 106 of the engine compartment 30 is an internal wall and the external wall 116 corresponding to side wall 104 serves, together with wall 106 and a portion of roof 108 and of tank 94, to define a control compartment 118 adjacent the engine compartment for a purpose to be described.

Both the engine compartment 30 and the control compartment 118 are provided with peripheral sealing strips 120 and 122 respectively, mounted on flanges 124 and 126 for engagement with the upper surface of water tank 94 so that the compartments are sealed against the inflow and outflow of air otherwise than through the openings provided in the compartments as described below.

Side wall 106 of engine compartment 30 is in two parts. An upper part 128 is carried by and extends downwardly from roof 108, and a lower part 130 is mounted on the upper wall 132 of water tank 94. A sealing strip 134 of resilient material is provided on lower wall portion 130 to provide sealing engagement when the refuse tank is lowered to its working position. Sealing strip 134 is seen in FIG. 5. Upper wall portion 132 has a generally rectangular-shaped cut out to receive lower portion 130.

Turning now to a consideration of the air flow paths in refuse collecting apparatus 12, the first air duct 40 which connects the fan air inlet 36 to refuse tank 26 comprises a transverse portion 136 connecting inlet 36 to the four compartments of roof 108, and a longitudinal portion provided by roof 108 itself. A transverse screen 140 is provided at the rear end of duct portion 138 to prevent the entry of foreign matter.

A third air duct 142 connects the air outlet 38 of fan 32 to a primary air outlet 144 formed in roof 108 of engine compartment 30. Third air duct 142 extends alongside and parallel to duct portion 136 and comprises a silencer 146 and curved baffles 148. Silencer 146 comprises four rectangular-section parallel tubes 150 surrounded and separated by sound absorbant material. Baffles 148 direct the air flow from tubes 150 upwards through outlet 144.

A secondary air inlet 152 and a secondary outlet 154 are formed in side wall 106 and roof 108 respectively, of engine compartment 30 for the passage through the compartment of a stream of air for cooling engine 28. A secondary fan 156 is mounted on an extension 158 of crankshaft 54 to cause the stream of air to pass through the engine compartment. A heat exchanger in the form of a radiator 160 connected to engine 28 to receive heated fluid therefrom is positioned at inlet 152 and within control compartment 118 so that air drawn into the engine compartment through the inlet passes over the heat exchange surfaces of the radiator. Thus secondary fan 156 draws air from control compartment 118 into engine compartment 30, the air passes over the engine and out through the elongated secondary air outlet 154.

Control compartment 118 has its own air inlet 162 provided (see FIG. 3) in the front wall 164 of compartment 118.

Within control compartment 118 are located all the hydraulic, electrical and pneumatic control systems for the refuse collecting apparatus 12. A hydraulic pump 166 is mounted on shaft 158 to be driven thereby. Shaft 158 extends through a central opening 168 provided in radiator 160. FIG. 5 shows items 170 of the control equipment in compartment 118 as exposed to view upon raising refuse tank 26.

In use, fan 32 causes suction at nozzle 24 and refuse is drawn into tank 26 through air duct 40 and deposited in the tank. Air is drawn out of the tank through first air duct 40 and discharged from fan outlet 38 through silencer 146 and discharged upwardly over baffles 148 through primary air outlet 144. Engine 28 is cooled by air drawn by fan 156 through inlet 162 and radiator 160, this air being discharged upwardly through secondary air outlet 154.

Among the advantages provided by the embodiment of the invention described above are the following:

1. The direct mounting of fan 32 on engine crankshaft 54 eliminates the conventional transmission between them, reducing power losses, noise generation and the requirement for maintenance and providing a considerable space saving whereby refuse tank 26 can be considerably enlarged.

2. The provision of thrust means to offset the axial thrust exerted on crankshaft 54 by fan 32 enables the use for the auxiliary engine of an engine having conventional bearing arrangements, without risk of overloading these bearing arrangements.

3. The mounting of the engine directly above the water tank further reduces noise emitted from the vehicle. The water tank itself is also not subjected to vacuum cycles as occurs with conventional road sweeper layouts in which the water tank is integral with the refuse tank.

4. The primary and secondary air flows are kept entirely separate and do not interact or mix.

5. Noise generation at the outlet of the primary air flow is reduced by the provision of a silencer.

6. The engine compartment is entirely sealed to reduce noise emission and provide control of heat dissipation.

7. All control equipment is located in control compartment 118 which is provided with a supply of cool clean air from between the engine compartment and cab 16 whereby the control equipment functions reliably.

Among modifications which could be made in the above embodiment are:

1. The use of a refuse collecting nozzle formed by the end of a large diameter manually positionable duct (known as a wanderhose) connected to the refuse tank for removing refuse from bins. This could be used instead of or in addition to nozzle 24.

2. The nozzle could be formed by the end of a standpipe to be lowered into gullies, in the case of a gully emptying machine.

3. The fan mounted on the auxiliary engine crankshaft may itself form the flywheel of the engine.

4. The air inlet to the control compartment could be in the top wall of that compartment.

We claim:

1. Road sweeping apparatus comprising:
brush gear;
mounting and drive means for the brush gear;
a refuse collecting nozzle associated with the brush gear to collect material swept by the brush gear;
a refuse tank;
a fan assembly;
air ducts connecting the fan assembly to the refuse tank, and connecting the refuse tank to the refuse collecting nozzle whereby the fan assembly can be caused to generate suction at the nozzle so as to draw refuse into the tank;
an auxiliary internal combustion engine drivably connected to the fan of the fan assembly; and
a water tank and associated spray gear to spray water during sweeping operations;
said auxiliary internal combustion engine being mounted directly above the water tank.

2. The apparatus of claim 1 wherein said fan assembly includes a fan housing enclosing the fan and defining an air inlet and an air outlet; said air ducts comprising a first air duct and a second air duct opening into the refuse tank, said first air duct being connectible to the air inlet of the fan housing, said refuse collecting nozzle being connected to said second air duct, said internal combustion engine comprising a crankshaft and crankshaft bearings supporting the crankshaft for rotation, said fan being mounted on the crankshaft at one end of the crankshaft, and said crankshaft bearings and no other bearings serving to support for rotation both the crankshaft and the fan.

3. The apparatus of claim 2 wherein a flywheel is mounted at one end of the said crankshaft, said fan being rigidly secured by fasteners to the flywheel.

4. The apparatus of claim 2 including thrust means for applying to the crankshaft a compensating axial thrust to offset the axial thrust applied thereto by the fan.

5. The apparatus of claim 4 wherein said thrust means comprises a plate mounted for rotation with the fan, the plate forming one end wall of a chamber and the opposite end wall of said chamber being free of support by said crankshaft bearings, said thrust means further comprising means to reduce the air pressure in said chamber.

6. The apparatus of claim 5 wherein said fan is a tangential flow fan and has fan blades which are mounted at one side of a mounting plate, said chamber being provided at the other side of the mounting plate, and the mounting plate providing said one end wall of the chamber.

7. The apparatus of claim 5 wherein said means to reduce the air pressure in said chamber comprises at least one orifice formed in said plate.

8. The apparatus of claim 5 wherein said means to reduce the air pressure in said chamber comprises a conduit extending from the chamber to a region of low air pressure generated by the fan.

9. The apparatus of claim 1 wherein said fan assembly includes a primary fan mounted for rotation by said engine, a fan housing enclosing the primary fan and having an air inlet and an air outlet, said air ducts comprising a first air duct connecting the air inlet of the fan housing to the refuse tank and a second air duct connecting the refuse collecting nozzle to the refuse tank, an engine compartment enclosing the internal combustion engine and the primary fan and housing therefor, a third air duct connecting the air outlet of the housing of the primary fan to a primary air outlet formed in the engine compartment, a secondary air inlet and a secondary air outlet formed in the engine compartment for the passage through the compartment of a stream of air for cooling the internal combustion engine, a secondary fan to cause the stream of air to pass through the engine compartment, a heat exchanger connected to the internal combustion engine to receive heat therefrom and positioned in the path of said stream of air at the secondary air inlet so that air drawn into the engine compartment through the inlet passes over heat exchange surfaces of the heat exchanger, and control means for the refuse collecting apparatus positioned outside the engine compartment in the path of the said stream of air on the upstream side of the heat exchanger.

10. The apparatus of claim 9 wherein said control means are located in a control compartment adjacent the engine compartment and having its own air inlet to admit said stream of air for passage through said secondary air inlet.

* * * * *